US006387348B1

(12) United States Patent
Ferrell et al.

(10) Patent No.: US 6,387,348 B1
(45) Date of Patent: May 14, 2002

(54) METHOD FOR TREATING SPENT CAUSTIC STREAMS

(75) Inventors: Robert J. Ferrell, Rutherford; Thulasidas Chellppannair, Edison; James K. Tseng, Berkeley Heights, all of NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/481,950

(22) Filed: Jan. 12, 2000

(51) Int. Cl.[7] ..... C01D 1/00; C01D 15/02; C01D 3/06; C22B 26/10

(52) U.S. Cl. ..... 423/642; 423/641; 423/183

(58) Field of Search ..... 423/641, 642, 423/183

(56) References Cited

U.S. PATENT DOCUMENTS 3,989,797 A * 11/1976 Brady et al. ..... 423/242
4,009,251 A * 2/1977 Meuly ..... 423/573 G
4,894,217 A * 1/1990 Ostman ..... 423/659
5,470,486 A * 11/1995 Gillespie ..... 210/758
6,051,740 A * 4/2000 Matson et al. ..... 568/59

FOREIGN PATENT DOCUMENTS

EP WO94/01616 * 1/1994 ..... D21C/11/00

* cited by examiner

*Primary Examiner*—Steven P. Griffin
*Assistant Examiner*—Jonas N. Strickland
(74) *Attorney, Agent, or Firm*—Philip H. Von Neida; Salvatore P. Pace

(57) ABSTRACT

Sulfur compounds present as sulfides and mercaptans in spent caustic streams from refinery and petrochemical processes are oxidized by contacting them with an oxygen-containing gas in a packed column recycle reactor.

10 Claims, 1 Drawing Sheet

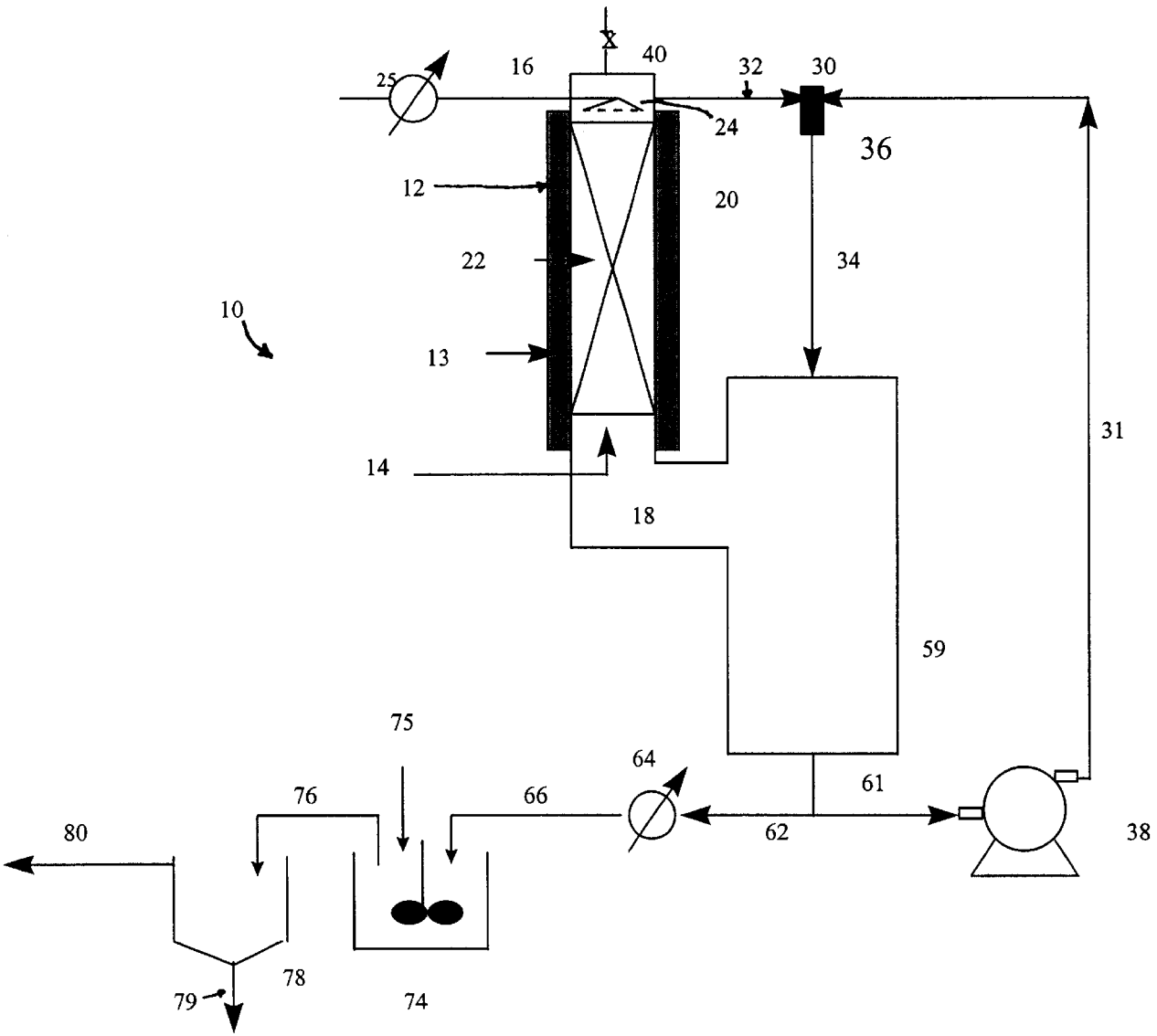
10
12
13
14
16
18
20
22
24
25
30
31
32
34
36
38
40
59
61
62
64
66
74
75
76
78
79
80

METHOD FOR TREATING SPENT CAUSTIC STREAMS

FIELD OF THE INVENTION

The present invention provides for a method for the treatment of waste caustic streams from process industries such as refining and petrochemical. More particularly, the present invention provides for a process for treating caustic waste or spent streams containing sulfur compounds with a packed column recycle reactor for the oxidation of the sulfur compounds in the waste stream.

BACKGROUND OF THE INVENTION

Due to the presence of sulfur compounds in the crude oil, the refined products like gasoline, LPG and diesel fuel contain sulfur compounds including mercaptans and sulfides. These sulfur compounds must be removed from the hydrocarbon products for odor control and to avoid corrosion problems. A common post-refining sulfur-removal method is caustic washing in which the hydrocarbon streams are contacted with concentrated solutions of caustic soda. The caustic soda reacts with hydrogen sulfide to form sodium sulfide and with mercaptans to form sodium mercaptides. The caustic stream loaded with the above compounds is called spent caustic. A typical spent caustic stream from a refinery contains as much as 10 to 170 g/L of sodium sulfide, 100–1000 ppm of mercaptans and traces of phenols and disulfides. The composition of the spent caustic stream from a petrochemical industry is very similar.

It is economically prudent to regenerate and recycle the spent caustic; the sulfur compounds present in the spent caustic must be oxidized and removed for this disulfides. The composition of the spent caustic stream from a petrochemical industry is very similar.

It is economically prudent to regenerate and recycle the spent caustic; the sulfur compounds present in the spent caustic must be oxidized and removed for this purpose. The oxidation could be performed with air or oxygen. During oxidation, the sodium sulfide is converted to thiosulfate or sulfate; however complete oxidation to sulfate is preferred. The mercaptans are more resistant to oxidation as compared to sulfide. It is known in the open literature that in a strong oxidizing environment, mercaptans are oxidized to disulfide and subsequently to sulfonic acid.

The spent caustic is very odorous and the COD is very high. Hence, even in places where recycling of the spent caustic is not practiced, the mercaptans must be destroyed and the sodium sulfide must be oxidized to environmentally acceptable sulfate for caustic neutralization followed by biological treatment and disposal. This invention describes a process with a packed column recycle reactor for the oxidation of the sulfur compounds in the spent caustic stream for its regeneration and recycling or environmentally acceptable disposal.

SUMMARY OF THE INVENTION

The present invention provides for a method for oxidizing sulfur compounds in spent caustic from process industries. The improved method comprises contacting an oxygen-containing gas and spent caustic in a column having structured packing by introducing the spent caustic stream and the oxygen-containing gas into the top and the bottom of the column respectively. The partially oxidized spent caustic is withdrawn from the column bottom into a vessel where it is drawn from the bottom of the vessel and recirculated. The gas phase from the column top is directed into the vessel where the gas phase disengages from the liquid phase and is recirculated to the packed column.

The fully-oxidized spent caustic is withdrawn into a reactor vessel. The sodium sulfate present from the oxidation of the sulfur compounds in the packed column is transferred in solution to a reactor vessel where it is reacted with slaked lime to form calcium sulfate and sodium hydroxide.

The calcium sulfate is relatively insoluble and precipitates. The precipitate can be removed to a clarifier with the calcium sulfate removed as a slurry and the supernatant caustic stream recycled and mixed with the make-up solution prior to its use elsewhere, for example, in caustic washing.

As such, the present invention represents an improvement in that destruction of mercaptans is achieved without the use of ozone or peroxide and the disulfides that result from the mercaptan oxidation are fully oxidized to sulfates. With the elimination of the expensive ozone or peroxide polishing step, a lower capital and operating cost results. Additionally, organics such as phenols are partially destroyed which will reduce the load on subsequent biological treatment.

DESCRIPTION OF THE RELATED ART

U. S. Pat. No. 5,439,556 teaches a method for oxidizing sodium sulfide present in white liquor utilized in the pulping of wood to sodium sulfate. An oxygen-containing gas and the white liquor are contacted in a column where oxygen and sodium sulfide react to form an oxidized white liquor which is withdrawn from the bottom of the column. The present invention improves on this process in that the concentration of sulfide in process streams is four to five times higher than in white liquor streams. Mercaptans are also present in process streams as well as other compounds such as phenols. Lastly, the '556 patent teaches that there is heat generated by the exothermic oxygen/sodium sulfide reaction. The inventive process will generate more heat due to the higher sulfide and mercaptan concentrations in process streams.

BRIEF DESCRIPTION OF THE DRAWING

The FIGURE is a schematic representation of the apparatus for carrying out a method in accordance with the present invention.

DETAILED DESCRIPTION OF THE INVENTION

Apparatus 10 consists of a liquid/vapor contacting column 12 of approximately 9.84 meters in height by about 0.9 meters in diameter. Column 12 is provided with an oxygen inlet 14 and a spent caustic inlet 16 to bottom and top regions 18 and 20 of column 10 respectively. An oxygen stream is introduced into the column through inlet 14 and a spent caustic stream is introduced into the column through inlet 16.

The spent caustic and oxygen are brought into intimate contact by contacting elements which are preferably formed by beds of structured packing designated by reference numeral 22. As would be known by those skilled in the art, liquid distributors would be located between pairs of beds. The spent caustic is introduced into structured packing 22 by a liquid distributor 24 and the oxygen rises through the open area of structured packing 22. Structured packing is efficient and has a very low pressure drop. This allows the recycling of the gas stream without a blower. As will be discussed, a simple eductor is sufficient. It is to be noted that to preclude clogging of the packing by particulates, the packing type and crimp angle are important. In this regard, structured packing 22 can have a packing density of between about 500 $m^2/m^3$ and is preferably Koch Type 1X or 1Y which can be obtained from Koch Engineering Company, Inc., of Wichita, Kan. Random packing and trays could also be used with less effectiveness.

In order for the reaction to proceed as mentioned above, an oxygen containing gas can be used so long as the total pressure during the reaction does not drop below about 9.2 atmospheres absolute. The oxygen should have a purity as high as is economical with 90% and above being preferred. The reaction should proceed at a total pressure of no less than about 9.2 atmospheres absolute and more preferably at least about 11.2 atmospheres absolute. Additionally, the reaction between the oxygen and the sodium sulfide should occur at a minimum temperature of about 110° C. A minimum reaction temperature of about 120° C. is more preferred and reaction temperatures at or above 150° C. are particularly preferred. A particularly preferred temperature and pressure are about 200° C. and about 18 atmospheres absolute. As mentioned above, the minimum pressure for conducting a process in accordance with the present invention would increase five-fold in air.

The reaction of oxygen and sodium sulfide is an exothermic reaction. However, to start the reaction, heat must be added to the spent caustic to raise it to the requisite reaction temperature. To this end, a heat exchanger 25 can be provided before inlet 16 in which the incoming spent caustic is heated by indirect heat exchange with steam. After the reaction progresses, heat exchanger 25 can be shut down. The heat exchanger could also be charged on the hot side with treated spent caustic.

The oxidized spent caustic collects as a column bottom 26 of column 59. At the same time, an oxygen-containing tower overhead collects within top region 20 of column 12.

It is possible to conduct a method in accordance with the present invention in which a stream of the column overhead is continually vented. In such case, a high rate, approximately three to four times the stoichiometric rate of pure oxygen, would be supplied through oxygen inlet 14. This would produce excess oxygen which when vented as tower overhead could be used for other oxygen applications elsewhere. In order to prevent cooling of the column through evaporation of water, the oxygen should be pre-saturated at the column temperature.

For the most common concentrations of sodium sulfide, it is necessary to circulate the tower overhead rather than vent it so that the oxygen added into the column is a saturated gas at the desired column temperature. Cold, unsaturated gas can serve to cool the column and thereby inhibit the reaction. This recirculation is effected by pumping a stream of the column overhead into the bottom region 18 of column 12. Not only does this conserve oxygen, but also it has been found to make the vapor/gas conditions, such as temperature and composition, more uniform throughout the packing, and to flatten the vapor flux profiles along the column length. The end result is that less packing has to be utilized with recirculation because all parts of the column are operating in high efficiency regions.

Because of the heat generated by the reaction, the column must be cooled. Any conventional means for cooling the packed column may be applied such as a cooling jacket 13 or cooling coil wrapped around the column.

Although a blower could be used to recirculate the column overhead stream, it has been found that, more efficiently, the column overhead stream can be circulated by an eductor 30 having a low-pressure inlet 32. A stream of in-process spent caustic is directed by a pump 38 through line 31 through eductor 30. Low-pressure inlet 32 of eductor 30 draws the column overhead stream from top region 20 of column 12. The pumped oxidized spent caustic is introduced into a high-pressure inlet 36 of eductor 30 and a combined stream of column overhead and oxidized spent caustic is discharged through line 34 to a vessel 59 which connects with the column bottom where the gas phase is recirculated.

Stripped gas impurities and reaction products which may serve to dilute the tower overhead stream and thereby lower oxygen partial pressure can collect at the top of column 12. In order for such gas impurities and reaction products to not affect the reaction, they can be periodically or continually vented through the use of a small vent 40 provided for such purpose.

Although not illustrated, the incoming spent caustic feed could be preheated by introducing it into a heat exchanger located within bottom region 26 of column 59. The heat exchanger would be provided with a conduit connected to liquid distributor 24. Additionally, part of the pumped spent caustic stream could be diverted from eductor 30 to spent caustic inlet 16 to preheat the spent caustic by direct heat exchange. In addition to preheating the spent caustic feed through the use of a heat exchanger in bottom region 26 of column 59, an external heat exchanger utilizing steam could be used to further heat the spent caustic feed prior to its entry into liquid distributor 24.

A line 61 leads from the bottom of the vessel 59 to a line 62 and connects with a pump 38 where the partially oxidized spent caustic is recirculated through eductor 30 to the packed column. Line 61 also connects to a heat exchanger 64 where the hot spent caustic stream is cooled prior to entering mixed reactor 74 through line 66.

Line 66 leads from the heat exchanger 64 to mixed reactor 74 where the caustic stream is reacted with slaked lime, $Ca(OH)_2$, which is added through line 75. The sodium sulfate present in the fully-oxidized caustic stream reacts with the lime and calcium sulfate precipitates. The calcium sulfate slurry is removed via line 76 into a clarifier 78 and is removed from the bottom of the clarifier through line 79 where it can be treated either biologically or by other treatment to render environmentally acceptable for disposal. The supernatant caustic stream exits the clarifier through line 80 where it can be either recycled and mixed with make up solution for use elsewhere in caustic washing or disposed in an environmentally friendly manner.

Typical industrial flow rates for apparatus 10 can be about 178.0 liters/min of spent caustic containing about 10–170 g /l of sodium sulfide. The recirculation factor (recirculation rate in kg/sec. divided by rate that oxygen is supplied in kg/sec.) of tower overhead should be between about 3.0 and 4.0 to maintain an $F_s$ (allowable gas load or gas velocity times gas density$^{0.5}$) of between 1.0–1.3 $(m/s)(kg/m^3)^{0.5}$ where structured packing 22 (Koch FLEXIPAC 1Y) is most efficient. The resulting pressure drop is in the order of about 0.017 to about 0.008 meters of water per meter of packing. A 0.15 meter diameter eductor 30 (such as can be obtained from Baker Process Equipment Co., Inc., Corropolis, Pa.) with a large nozzle and a pumped spent caustic flow of between about 303.0 liters/min at about 16.4 atmosphere absolute will produce the necessary gas recirculation. Consequently, only a very small recirculation pump need be used having low power requirements.

Mercaptans are more resistant to oxidation compared to sulfides. Typically, mercaptans are oxidized in the presence of a catalyst. However, the oxidation of mercaptans in a caustic solution without a catalyst was tested in an autoclave reactor at elevated temperatures and pressures. A sample caustic waste was prepared as 25 wt % sodium hydroxide with less than 1000 ppmw of propyl mercaptan. This solution was then loaded into a 1 L autoclave reactor and oxidized with oxygen at 150° C. and at 14.6 ATM absolute. Samples were withdrawn at regular intervals and analyzed for propyl mercaptan. The reaction was followed by measuring the depletion of mercaptan over time. The mercaptan was completely oxidized without a catalyst in about 10 minutes. Spent caustic contains primarily methyl and ethyl mercaptans which are more reactive than propyl mercaptans and should be readily oxidized in the packed column.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

Having thus described the invention, what we claim is:

1. A method for oxidizing sulfur compounds selected from the group consisting of sulfides, disulfides, thiosulfates and mercaptans in spent caustic streams comprising contacting an oxygen-containing gas and a spent caustic stream in a packed column containing no catalyst, whereby oxygen is dissolved in said spent caustic stream, thereby producing an oxidized spent caustic, withdrawing said oxidized spent caustic into a mixed reactor and reacting said oxidized spent caustic with calcium hydroxide to form sulfate compounds.

2. The method as claimed in claim 1 wherein said oxidized spent caustic is recirculated through an eductor on the top of said packed column.

3. The method as claimed in claim 1 wherein said oxygen-containing gas is recirculated through said packed column.

4. The method as claimed in claim 1 wherein said mercaptans are methyl and ethyl mercaptans.

5. The method as claimed in claim 1 wherein said spent caustic stream is from a refinery or petrochemical process.

6. The method as claimed in claim 1 wherein said oxygen-containing gas is selected from the group consisting of oxygen and air.

7. The method as claimed in claim 1 wherein said spent caustic stream contains from about 10 to about 170 grams per liter of sodium sulfide.

8. The method as claimed in claim 1 wherein said spent caustic stream contains from about 100 to about 1000 parts mercaptan per million parts of said caustic stream.

9. The method as claimed in claim 1 wherein said packed column operates at a temperature of about 110° to about 200° C. and a pressure of about 9 to about 20 atmospheres absolute.

10. The method as claimed in claim 1 further comprising removing phenols from said spent caustic stream.

* * * * *